US011944135B2

(12) United States Patent
Kerr et al.

(10) Patent No.: US 11,944,135 B2
(45) Date of Patent: Apr. 2, 2024

(54) WATERSPORTS GARMENT

(71) Applicant: ZHIK PTY LTD, Artarmon (AU)

(72) Inventors: Andrue Kerr, Artarmon (AU); Ryan Paxton, Artarmon (AU)

(73) Assignee: Zhik Pty Ltd, Artarmon (AU)

( * ) Notice: Subject to any disclaimer, the term of this patent is extended or adjusted under 35 U.S.C. 154(b) by 0 days.

(21) Appl. No.: 17/362,207

(22) Filed: Jun. 29, 2021

(65) Prior Publication Data

US 2021/0401074 A1 Dec. 30, 2021

(30) Foreign Application Priority Data

Jun. 30, 2020 (AU) ..... 2020902202

(51) Int. Cl.
*A41D 13/012* (2006.01)
*A41D 27/20* (2006.01)

(52) U.S. Cl.
CPC ..... *A41D 13/012* (2013.01); *A41D 27/201* (2013.01)

(58) Field of Classification Search
CPC .. A41D 1/02; A41D 2600/20; A41D 13/0005; A41D 27/18; A41D 27/20; A41D 7/00
See application file for complete search history.

(56) References Cited

U.S. PATENT DOCUMENTS 744,351 A * 11/1903 W ..... A41D 27/18 2/98
1,220,895 A * 3/1917 Sanborn ..... A41D 27/18 2/98
1,335,505 A * 3/1920 Huntington ..... A41D 27/18 2/87
1,404,305 A * 1/1922 Lang ..... A41D 27/18 66/172 R
2,046,565 A * 7/1936 Lawton ..... B63C 11/02 2/2.17
2,507,322 A * 5/1950 Smith ..... A41D 3/00 D2/831
4,507,806 A * 4/1985 Coombs ..... A41D 13/00 2/85
4,959,876 A * 10/1990 Kalaam ..... A62B 17/003 2/81
5,072,456 A * 12/1991 Elin ..... A41D 13/0012 2/253
5,153,941 A * 10/1992 Grilliot ..... A41D 13/0002 2/81
5,297,295 A * 3/1994 Barbeau ..... A62B 17/003 2/81
5,718,000 A * 2/1998 Ost ..... A41D 13/0012 2/93
5,896,578 A * 4/1999 Hunter ..... A41D 13/012 2/2.15
5,898,934 A * 5/1999 Hunter ..... B63C 11/04 2/2.15
5,991,924 A * 11/1999 Grilliot ..... A62B 17/001 2/81

(Continued)

*Primary Examiner* — Jillian K Pierorazio
(74) *Attorney, Agent, or Firm* — Nixon & Vanderhye P.C.

(57) ABSTRACT

A seal for a garment comprising a body portion. The body portion having an upper edge, a lower edge, a first end and a second end. The lower edge fixed to the garment at an opening; and wherein the second end of the seal comprises a tab which is adapted to cover a portion of the first end to form a seal.

12 Claims, 10 Drawing Sheets

(56) References Cited

U.S. PATENT DOCUMENTS

| | | | | | |
|---|---|---|---|---|---|
| 6,029,270 | A * | 2/2000 | Ost | A41D 27/04 | 2/2.5 |
| 6,934,970 | B1 * | 8/2005 | Watkins | A41D 13/0512 | 2/96 |
| 7,152,247 | B2 * | 12/2006 | Parsons | A41D 13/0012 | 2/253 |
| D627,950 | S * | 11/2010 | Carpentier | D2/750 | |
| 7,954,173 | B2 * | 6/2011 | Collier | A41D 3/00 | 2/93 |
| 8,490,219 | B2 * | 7/2013 | Seguin | A41D 13/0012 | 2/81 |
| D829,412 | S * | 10/2018 | Karim | D2/828 | |
| 2006/0048293 | A1 * | 3/2006 | Lewis | A41D 27/18 | 2/468 |
| 2006/0253958 | A1 * | 11/2006 | Debrick | A41D 27/18 | 2/206 |
| 2008/0163404 | A1 * | 7/2008 | Carpentier | A41D 13/0512 | 2/81 |
| 2010/0031415 | A1 * | 2/2010 | Shadid | A41D 13/0012 | 2/87 |
| 2013/0185840 | A1 * | 7/2013 | Grozdev | A41D 13/0012 | 2/69 |
| 2015/0305420 | A1 * | 10/2015 | Daniels | A41D 1/02 | 2/93 |
| 2017/0156414 | A1 * | 6/2017 | Shadid | A41D 13/0012 | |
| 2017/0245567 | A1 * | 8/2017 | Fathollahi | A41D 27/205 | |
| 2018/0116305 | A1 * | 5/2018 | Cheuk | B63C 11/04 | |

* cited by examiner

WATERSPORTS GARMENT

This application is claims priority to AU Patent Application No. 2020902202 filed 30 Jun. 2020, the entire contents of which is hereby incorporated by reference.

TECHNICAL FIELD

The present invention relates to an improved garment which may be used for watersports. More particularly, the garment may be fitted with at least one of a pocket and/or a seal which can assist with utility when in use, comfort for the wearer, and a garment which can be used for a range of watersport activities while limiting ingress of liquids.

BACKGROUND

Waterproof garments used for sailing and other marine activities are commonly known in the art. These garments provide critical weather protection to persons adverse or wet weather conditions. These garments may have a number of functions or uses depending on the watersport activity.

A number of garments are known for being used within the water, such as wetsuits, dry suits, rash vest and swimsuits. These garments are generally made from a neoprene or foam material which helps insulate the wearer during use. Other garments may be jackets or coats which protect wearers on a vessel or in wet weather conditions, such as in a rainy environment or the like. With some garments, the wearer may be able to wear thermal garments underneath the suit for warmth and comfort, and the suit features water-tight seals at the neck, wrist and other openings to prevent the ingress of water. Full body dry suits generally have a large waterproof zipper to allow for donning and doffing of the garment. Other waterproof garments commonly used in marine sports include smocks and jackets that may also feature water-tight seals at the neck and/or wrist to prevent the ingress of water.

The garments are commonly made from waterproof laminated or coated composite textiles joined by stitching and/or gluing. Seams used to fabricate the garment are generally made watertight by the application of a hot-melt adhesive tape. However, these tapes can be costly, and are also a point of potential weakness for some watersports.

Garments designed for offshore sailing and watersports often feature a large collar that protrudes from the neckline of the garment. The collar is usually tight fitting and attempts to provide a degree of resistant to liquids entering into the garment. However, for these collars to be effective a seal between the wearer and the collar itself must be made. As the width of a wearer's neck will not be the same as that of a second wearer, generally speaking, a lot of wearers will experience discomfort when wearing the collar as their neck will not fit to a generic collar or neck seal shape. These features may also restrict the movement or comfort of a wearer in other ways when in use.

For at least these reasons, many sailors prefer to wear garments without any collar for conditions when a sealing collar are not critical for weather protection. This means that sailors are forced to carry two or more different garments on a vessel, which increases weight to the sailing vessel and also fills valuable storage space on board. Due to these added inconveniences, a person who would find benefit from such a protective garment may elect to not carry a garment with collar and hood protection, leaving them at risk in harsh conditions.

In addition, sailors are also faced with difficulty donning and doffing the garments during sailing and an increased the risk of water entering and saturating their undergarments during this process. An example of a waterproof garment is a waterproof sailing suit known as a drysuit. The sailor is able to wear thermal garments underneath the suit for warmth and comfort, the suit features water-tight seals at the neck, wrist and other openings to prevent the ingress of water. Full body drysuits generally have a large waterproof zipper to allow for donning and doffing of the garment. Other garments commonly used in marine sports include smocks and jackets that may also feature water-tight seals at the neck and/or wrist to prevent the ingress of water.

Said garments are commonly made from a waterproof laminated or coated textile joined by stitching and/or gluing, the said seams are commonly made watertight by the application of hot-melt adhesive tape. The textiles used to construct these garments generally have limited stretch and therefore not capable of forming a water-tight seal around the body at openings in areas such as the wrists, neck, ankles or other areas. It is commonly known in the art to provide watertight seals made from an elastomeric rubber material formed in a tubular cuff with a narrower opening sealing around the body and a larger opening joined to the opening of the garment. These elastomeric rubber seals may provide adequate elongation so that the seals can be stretched over the head, hands and/or ankles when donning and doffing the garment and fit securely around the neck, wrist and/or ankle once in place to provide a substantially water-tight seal. Another material which may be used is a polyurethane tricot or stretch fabric which can be used for form a seal. These types of seals also suffer from degradation during use, and in particular, degradation from UV radiation and sunscreen, which are common when wearing a garment for outdoor use.

Said rubber seals are general manufactured by a dipping process whereby a form is dipped into a liquid rubber and allowed to set. The rubber material used in these seals may also degrade over time due to exposure to ultraviolet light from the sun and/or ozone from pollution and therefore need to be frequently replaced. While some products also provide a neoprene or other synthetic rubber material coating on the outer face of the seal to provide improved protection from said degradation, it is still common for the seals to degrade during the normal working life of the garment, which is only exacerbated from frequent stretching of the seal.

Another common issue with the rubber seals known in the art is the poor tearing strength of the rubber causing the seals to be easily damaged during use, any minor scratch or puncture in the seals creates a stress point in the material and commonly leads to the propagation of a tear when the seals are stretched. In cases where a user may need to cut the seal to increase the size of the seal it is also common that the trimming process leaves the seal even more susceptible to tearing due to increased stress points created by imperfect trimming. Importantly it is common that when a seal is damaged due to tearing, it is not easily repairable as the tear propagates across the entire length and/or width of the seal.

As such, it may be desirable to provide for a garment with a seal which can provide a desired comfort for a wearer when being worn, while also reducing or restricting the ingress of fluids. Further, it may also be advantageous to allow for an improved seal which may have a longer lifespan relative to conventional seals.

Pockets are another feature which can be useful for a number of garments, however the versatility of pockets can vary depending on the size of the pocket, the depth of the pocket and the angle in which the pocket is orientated. As such, it may be desirable to include a pocket on a garment which can be used for a range of applications.

Any discussion of the prior art throughout the specification should in no way be considered as an admission that such prior art is widely known or forms part of common general knowledge in the field.

SUMMARY

Problems to be Solved

It may be advantageous to provide for a garment with a seal which can be easily donned and doffed.

It may be advantageous to provide for a seal which improves the comfort of the wearer during use.

It may be advantageous to provide for a utility pocket which can be incorporated onto a garment.

It may be advantageous to provide for a pocket which can be expanded or modified to accommodate various items.

It may be advantageous to provide for a seal which can be used to seal the neck and/or wrists and/or ankles of a wearer.

It may be advantageous to provide for a device which can be used to seal a limb of a wearer from ingress of fluid into a garment.

It may be advantageous to provide for an assembly which can be used to reduce ingress of fluids into a garment.

It is an object of the present invention to overcome or ameliorate at least one of the disadvantages of the prior art, or to provide a useful alternative.

Means for Solving the Problem

In a first aspect of the present invention, there may be provided a seal for a garment. The seal may comprise a body portion in which the body portion has an upper edge, a lower edge, a first end and a second end. The lower edge may be fixed to the garment at an opening, and wherein the second end of the seal may comprise a tab which may be adapted to cover a portion of the first end to form a seal.

Preferably, the tab may be fixed to the second end of the body. Preferably, the tab may comprise an attachment means adapted to secure to a corresponding attachment means on the body of the seal. Preferably, the tab and the first end upper edges may be angled downwardly relative to the second end upper edge, such that the tab and the first end converge at a location which may be relatively lower than the upper edge of the second end. Preferably, the seal may be a neck seal configured to reduce ingress of fluids around the neck of a wearer. Preferably, the seal may be a wrist seal configured to reduce ingress of fluids around the wrist of a wearer. Preferably, the seal may be formed at least in part from a closed cell foam may be selected from the following group; polyurethane foam, EVA foam, a two layer composite material, neoprene foam, styrene butadiene rubber foam, wherein the closed cell foam may be lamination to at least one of a knitted textile and a woven textile.

In a further aspect of the present disclosure, there may be provided a pocket for a garment. The pocket may comprise a front panel connected to a rear panel, each of the front panel and the rear panel having a respective inner surface. The inner surface of the front panel and the inner surface of the rear panel may define a major receptacle. An opening may be provided to access the major receptacle, and wherein the inner surfaces of the pocket comprise a mating means to releasably attach the inner surface of the front panel to the inner surface of the rear panel.

Preferably, the opening may be defined by an upper edge of the front panel and the rear panel. Preferably, the opening may be defined by a cut formed in the front panel. Preferably, the cut is sealable via at least one of a zipper and a hook and loop fastener. Preferably, at least one minor receptacle may be housed within the major receptacle. Preferably, the at least one minor receptacle has an opening formed between the rear panel and a side edge of the front panel. Preferably, the major receptacle may be configured to be opened and closed via an attachment means. Preferably, the mating means may divide the major receptacle into two or more discrete receptacles.

In the context of the present invention, the words "comprise", "comprising" and the like are to be construed in their inclusive, as opposed to their exclusive, sense, that is in the sense of "including, but not limited to".

The invention is to be interpreted with reference to the at least one of the technical problems described or affiliated with the background art. The present aims to solve or ameliorate at least one of the technical problems and this may result in one or more advantageous effects as defined by this specification and described in detail with reference to the preferred embodiments of the present invention.

DESCRIPTION OF THE INVENTION

Preferred embodiments of the invention will now be described with reference to the accompanying drawings and non-limiting examples.

REFERENCE LIST

Figure 1:
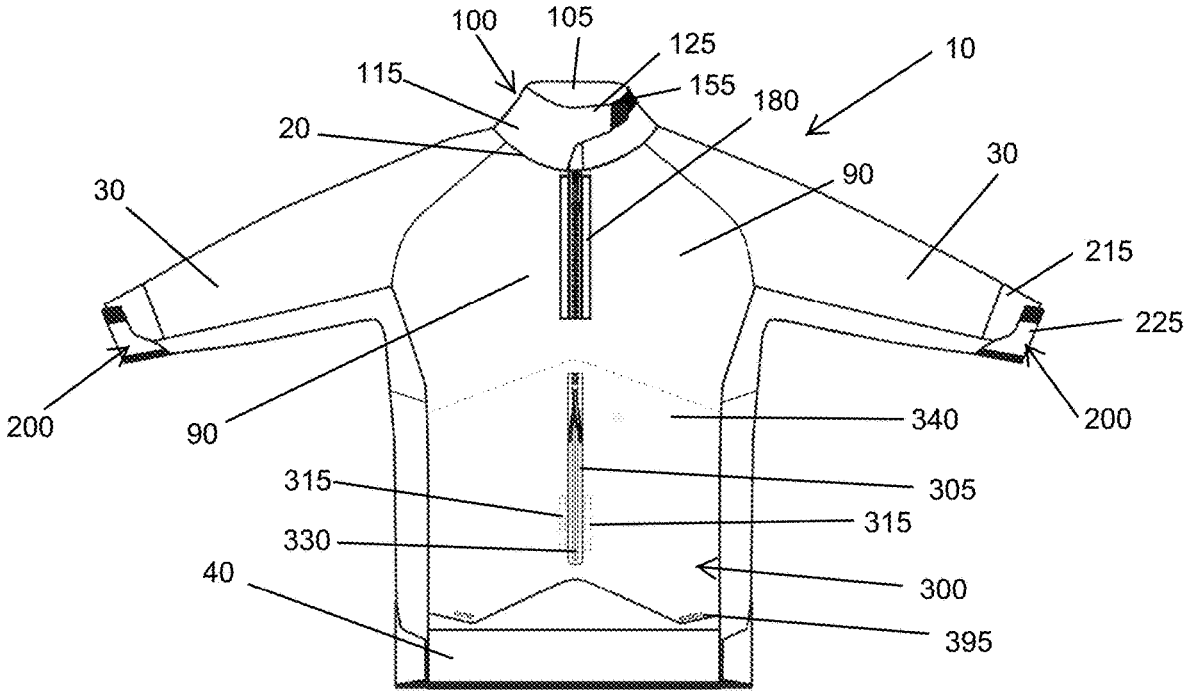
FIG. 1 illustrates a front view of an embodiment of a garment with a pocket, neck seal and wrist seals.

5 Wearer
10 Garment
20 Neck opening
30 Sleeves
40 Hem
50 Hood
60 Shield
70 Fitting Means
80 Anchor location
90 Chest portion
100 Neck seal
105 Opening
110 Upper edge
115 Body
120 Lower edge
125 Neck tab
127 Landing
128 Gusset seam
130 Gusset
131 Gusset cover
132 Gusset securing means
134 Corresponding gusset securing means
135 Upper edge of gusset
136 Securing element
137 Bonding locations
138 Sealing recess
139 Body extension
140 Crossing location
145 First end
150 Second end
155 Securing means
180 Zipper
185 Tab anchor
200 Wrist seal
205 Opening
210 Free edge
212 Wrist edge
215 Body portion
220 Connection edge
225 Tab
230 First end
235 Second end
240 Gap
245 Compressed region
280 Arcuate portion
285 Reinforcement
300 Pocket
305 Opening
310 Flap
315 Attachment means
320 Opening reinforcing
325 Divider
330 Zipper
335 Rear Panel
340 Front Panel
345 Upper edge
350 Lower edge
355 Right edge
360 Left edge
365 Reinforcing element
370 Primary receptacle
375 Anchor
380 Minor receptacle
385 Opening
390 Fastener
395 Apertures Referring to FIG. 1 there is illustrated an embodiment of a garment 10. The garment 10 shown may be a waterproof smock 10 which can be used for sailing, watersport use, or general wear. The garment 10 is preferably formed with a textile which has at least one water-repellent coating applied thereto, or is formed from a waterproof textile or a water-resistant textile. The garment 10 may be formed form a plurality of panels which are connected at seams. The seams may have at least one waterproofing means applied to the seams to reduce the potential of ingress of fluids into the garment 10. For example, the seams may have a waterproofing means such as a hot-melt adhesive seam tape or other bonding water proofing means known in the art.

The garment 10 shown is formed with a neck opening 20 which has a neck seal 100. The neck seal 100 may provide for an adjustable water-tight seal around the wearers neck when in use. Similarly, wrist seals 200 are provided at the ends of the sleeves 30 of the garment 10 and may be adjustable to allow for a desired fit against the wrist or limb of a wearer. Each of the neck seal 100 and the wrist seals 200 (also referred to herein as cuffs) may prevent ingress of liquids, such as water, entering into the garment 10. Each of the seals 100, 200 are preferably adjustable, and may be optionally opened to reduce the pressure on the neck or wrist of a wearer when there is little or no need to restrict or prevent water from entering into the garment, such as when weather conditions are not adverse or when the wearer is not exposed to liquids.

Figure 2:
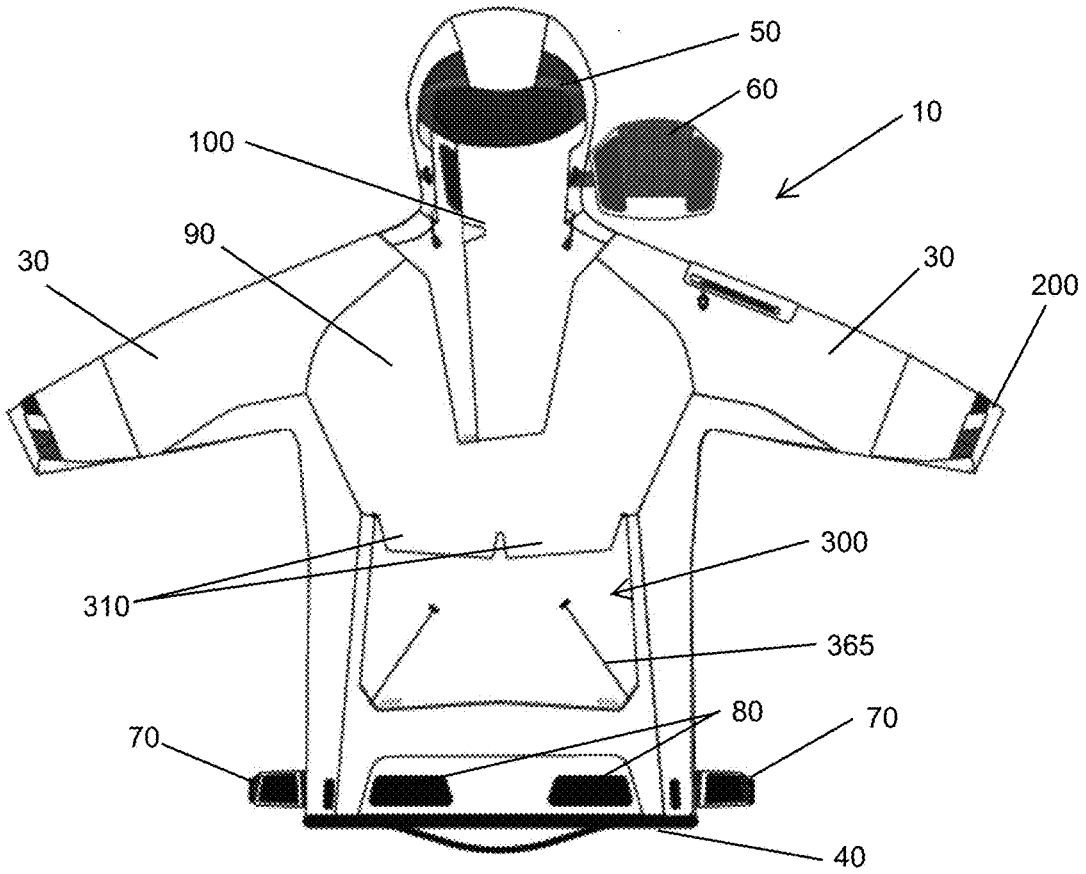
FIG. 2 illustrates a front view of another embodiment of a garment with a hood fitted over the neck seal.

While the garment 10 is shown as a smock or jacket in the illustrations, any garment may utilise the sealing features and pocket of the present disclosure. For example, raincoats, drysuits, wetsuits, ponchos, vests, or any other desired garment may utilise the seals 100, 200 and pockets 300. For example, the garment 10 of FIG. 2 illustrates a hood 50 mounted over the seal 100 which may be either integral with the garment or removably attachable to the garment 10. A face shield 60 may also be used with the hood of the garment 10. Optionally, near to the hem 40 of the garment a fitting means 70 may be disposed which can be connected to anchor points 80 to make a tighter fit at the hem 40 with the wearer.

The neck seal 100 may be formed from a neoprene material in some embodiments, or may be formed from any desired foam or composite material. Rubbers, rubber coatings, polyurethanes, and polyurethane coatings may also be used to form the seal or part thereof. It is preferred that materials which are relatively more comfortable be selected as the seals are adjustable.

The neck seal 30 of the garments 10 may have a limited stretch and therefore the neck opening 20 is sized to be larger than the head of a wearer to allow the wearer to fit through the neck opening 20. Similarly, wrist seals 200 are also generally sized to be larger than the hand of the wearer to allow it to fit through the wrist opening. The neck seal 100 and wrist seals 200 may each be formed from a different material than is used to form the garment 10. This may allow any desired material to be used for construction of the garment 10 which can be of benefit as some materials may provide an improved abrasion resistance or be relatively more durable than the seals 100, 200. In addition, this may reduce the overall construction costs of the garment if a multi-layered textile construction is used to form the garment 10.

A zipper 180 is provided on the front of the garment 10 to allow for adjusting the size of the seal neck opening 105 and adjustment of a gusset 130 (see FIG. 3A) of the seal 100. The seal 100 is connected to the neck opening 20 and is configured with zipper 180 such that opening the zipper can access at least a portion of the gusset 130 of the seal 100. The seal 100 extends around the neck opening of the garment 10 and may be contoured or anatomically formed to conform with the upper back and/or neck of the wearer.

Figure 3A:
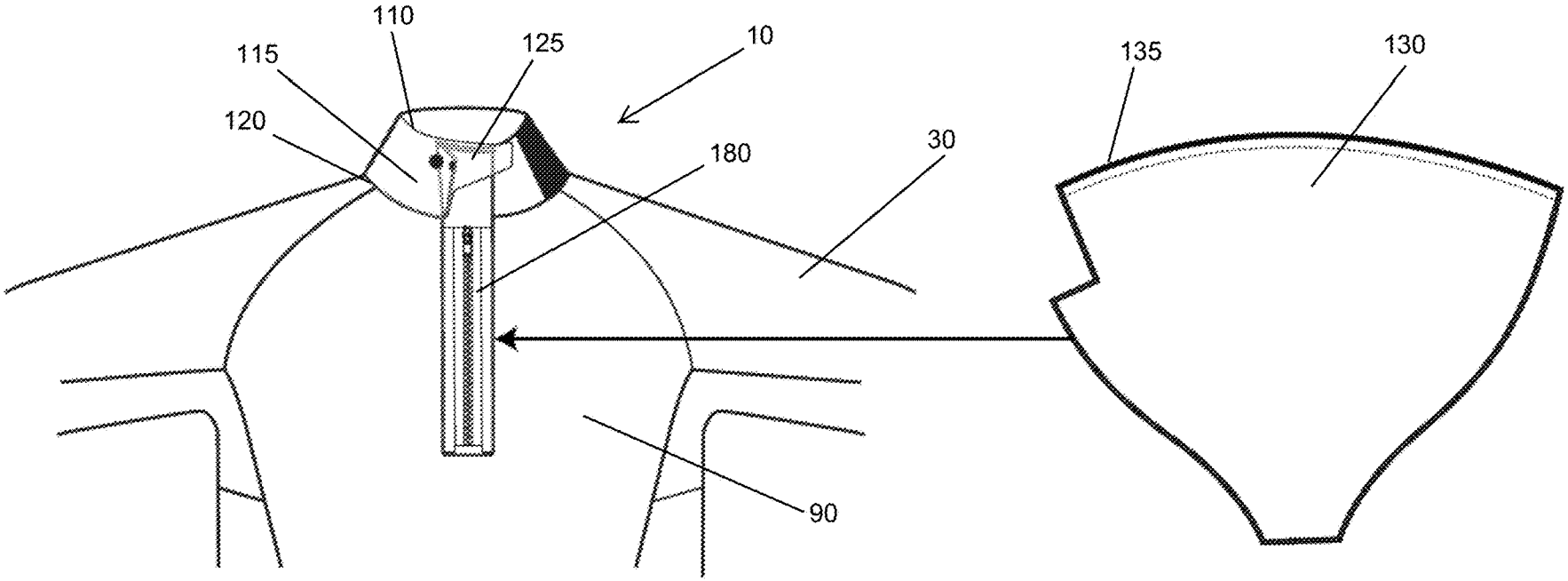
FIG. 3A illustrates a front view of a garment with a representation of a gusset which may form part of a neck seal.
Figure 3B:
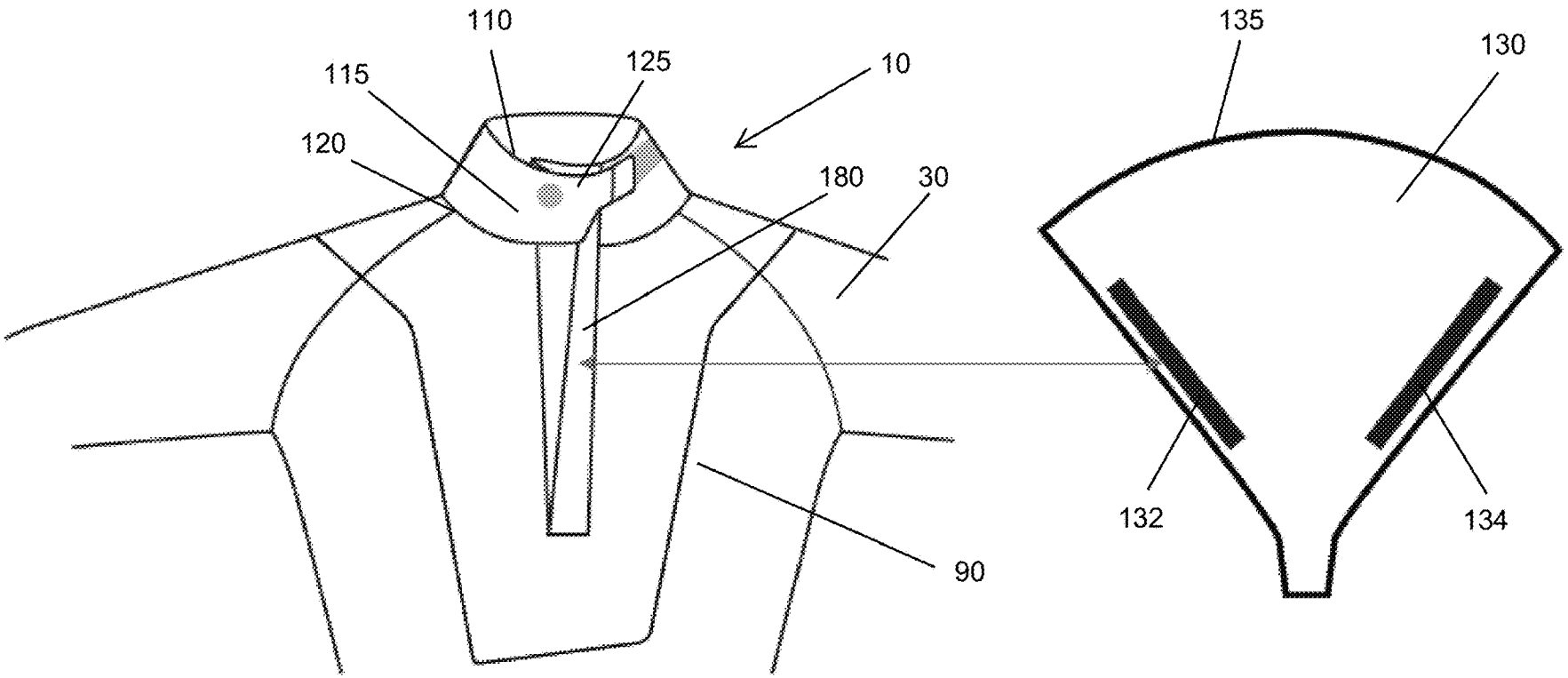
FIG. 3B illustrates a front view of a garment with a representation of another gusset which may form part of a neck seal.

In another embodiment, the gusset 130 may be fitted to a garment without a zipper 180 being present as shown in FIG. 3B. The gusset 130 may be folded or deformed to fold over itself, or be tucked into the garment 10. To retain the gusset 130 in place, the gusset may be fitted with a gusset securing means 132 which can connect to a corresponding gusset securing means 134 on the garment 10. The corresponding gusset securing means may be fixed to the chest region of the garment, or may be situated around the collar of the garment. The gusset securing means of the gusset 130 may extend from the top to the bottom of the gusset portion which is revealed on the chest of the garment 10. In this way the gusset 130 can be attached to the corresponding gusset securing means at any desired location, and may also assist with reducing ingress of fluids into the garment 10. The gusset securing means (and corresponding gusset securing means) may be similar in construction to that of the securing means 155. However, regardless of the gusset 130 with seal 100, the gusset is preferably formed to have a close profile when in a sealing configuration, such that the wearer does not feel, or has minimal feel, of the gusset when in use.

In the embodiment illustrated in FIG. 3B, the gusset securing means and corresponding gusset securing means 134 are hoop and loop fasteners, which are configured in a V-shape which can allow for the upper edge 135 of the gusset to have a relatively larger edge than the bottom of the gusset. The V-shape can assist with providing a more comfortable seal when in use. The V-shape may have an internal angle of between 25° to 80° to provide a desired closure configuration. Further, having a V-shape can direct fluids downward if they enter into the folded configuration when the securing means 132, 134 are mated. In addition, having the gusset fitted with a securing means 132, 134 will force the wearer to close the seal in a predetermined manner, and thereby reduce the potential for an inadequate seal to be made by the wearer. It will be appreciated that in other embodiments, the wearer may fold the gusset 130 in any desired way to form the seal, particularly if the securing means 132, 134 are omnidirectional securing means.

The seal 100 is formed from a body 115 which has an upper edge 110 and a lower edge 120. The lower edge being fixed with the garment 10 at the neck opening 20. When in a sealing configuration the upper edge 110 of the neck seal 100 will define an opening, which has a perimeter smaller than the perimeter of the lower edge connecting to the neck opening 20. In this way the seal can be angled or contoured from a relatively larger opening which can allow a wearer to easily pass their head through to an opening which can provide a seal between the garment and the wearer. When the seal 100 is in an open configuration the wearer may be allowed to pass their head through the opening 105 with relative ease. In a closed configuration the seal 100 may be configured around the neck of a wearer, but may not be considered to be in a sealing configuration.

A gusset 130 is positioned behind the zipper 180 and is connected to both the chest portion 90 of the garment 10 and also the neck seal 100. When the seal 100 is in an open configuration, the zipper 180 can be opened to reveal the gusset 130 below which can then be unfolded to allow donning and doffing the garment 10. The gusset may be fixed to either side of the zipper and connected to at least one portion of the body 115 of the neck seal 100. Each edge of the gusset 130 is preferably connected to the inner side of the chest portion around the zipper, such that if the zipper has an ingress of fluids the fluids do not enter into the garment 10. In this way, only upper edge 135 of the gusset 130 is free and may form a part of the seal of the neck seal 100, or may be relatively under the upper edge 110 of the neck seal 100 as is seen in FIG. 3A or 3B. The gusset 130 may be formed from a water-resistant material or have a functional coating applied thereto to provide a desired water repellency. Optionally, the gusset 130 may be formed from a neoprene or other closed cell foam material, or a composite material with one or more layers. A composite material may include one or more layers of fabric adhered or bonded together.

The upper edge 135 of the gusset 130 may have a reinforcing means, and/or may be fitted with a rubber, polymeric material or a waterproof coating layer which can be used to reduce, or preferably prevent, ingress of liquids into the garment via the neck seal 100. However, if the gusset 130 is positioned below the upper edge of the seal 100, the gusset may not require a rubber, polymeric material or a waterproof coating layer applied thereto.

In another embodiment, the seal 100 and/or gusset 130 is made from a warp knitted mesh textile. Suitable open cell foam or closed cell foams may be selected from the following group; polyurethane foams, EVA foams, neoprene foams, styrene butadiene rubber foams or other foams and are preferably lamination to knitted or woven textiles comprises of natural or synthetic yarns on one for both surfaces of the foam. The gusset 130 can have at least 50% elongation before failure along the axis to which is elongated to allow for comfortable donning and doffing. In a preferred embodiment, the gusset 130 is formed from a warp knitted or circular knitted textiles comprising elastane and other synthetic yarns with and elongation of more 100% or more before tensile failure. Similar materials may also be used for the wrist seals 200.

In yet a further embodiment, the gusset 130 may be configured to have more than 100% elongation and may allow the upper edge to have a perimeter which is at approximately the same size as that of the neck opening 20, or larger to more easily allow passing through the head of a wearer. In one embodiment, the gusset 130 can stretch or elongate in at least one plane between 100% to 400%.

A neck tab 125 is positioned at one end of the seal 100 and can be removably attached to the opposing end of the seal 100 such that a ring or tubular seal is formed. The securing means 155 may be any desired securing means 155, such as a button, hook and loop fastener arrangement (including ALFA-LOK™ style fasteners), a stud, a press lock, buckle, or any other predetermined securing means 155. It is preferred that the securing means 155 is a hook and loop fastener such that the seal 100 can be mounted around the neck of a wearer in a comfortable manner while also forming a seal 100. The securing means 155 may be disposed on the underside of the tab 125 such that it can connect to a corresponding securing means 155 on the body 115. It will be appreciated that the at least the tab 125 of the seal 100 will extend over a portion of the body when forming the seal and connecting to the corresponding securing means 155. The securing means 155 on the body 115 may be the loop portion of the securing means, which generally has a larger area than the securing means 155 on the underside of the tab 125. As the securing means 155 on the body 115 is relatively larger than the tab securing means, this can allow for a wearer to quickly form a liquid tight seal using seal 100 in difficult conditions, as alignment need not be precise to obtain the desired seal.

Figure 3C:
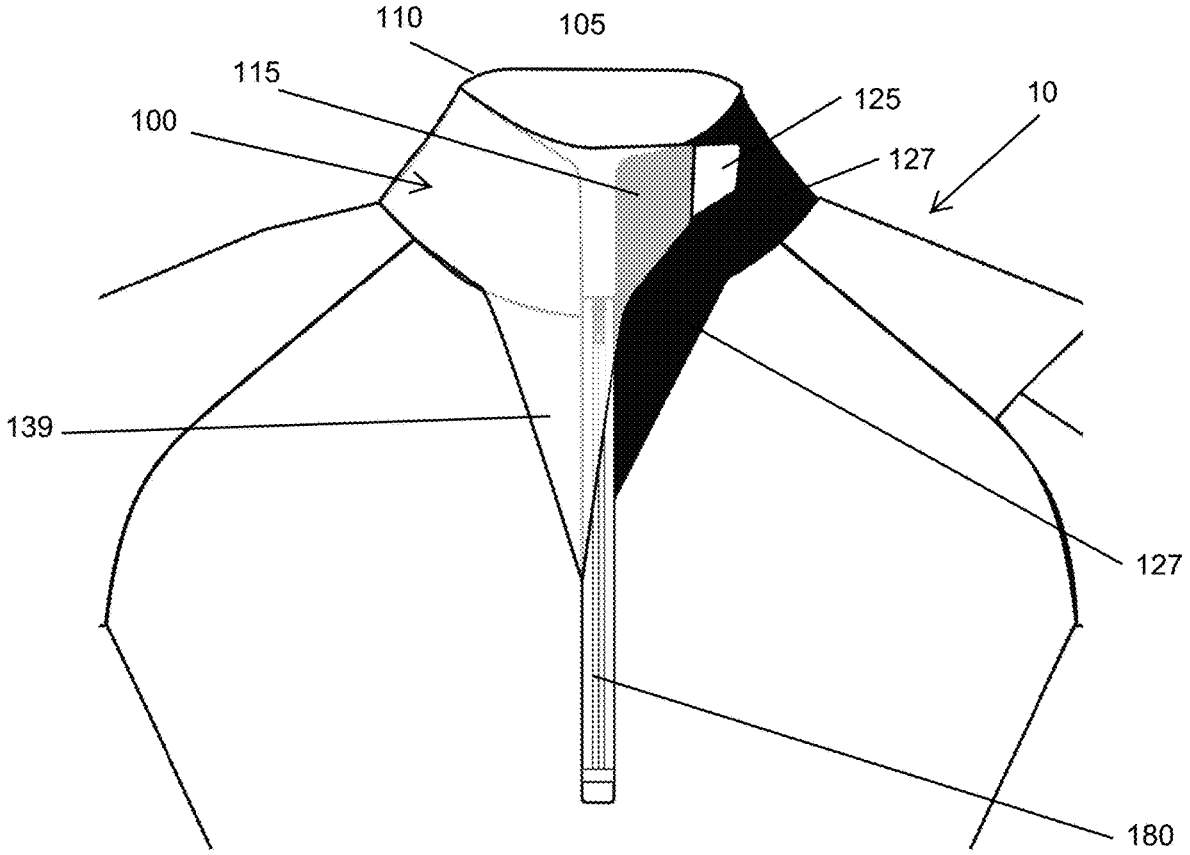
FIG. 3C illustrates an embodiment of a front view of a garment with a further gusset design.

Turning to FIG. 3C there is illustrated yet a further embodiment of a garment 10 with a neck seal 100. The seal 100 is shown as being partially transparent such that the zipper 180 is visible. Seal 100 comprises a gusset 130 similar to that of FIGS. 3A and 3B, however the seal 100 further comprises a body extension 139 portion that extends from the body 115 down adjacent to the zipper 180. The correct placement of tab 125 on landing 127 can be controlled more easily with the use of the extension 139, as the extension 139 may restrict the movement of the tab 125 to said correct placement position on the landing 127. A correct placement may be any placement which forms a liquid tight seal with the wearer. Optionally, the landing 127 is fitted with a securing means 155 which can be releasably fixed with the tab 125. Extension 139 generally extends relatively downwards from the body 115. Body 115 may be integrally formed with the extension 139, or may be attached with the extension 139. Each of the extension and the body may be formed from the same material, or a different material.

A portion of the zipper 180 may overlap at least a part of the gusset 130 and when the zipper 180 is closed, and when the zipper is closed the gusset 130 can be urged towards the wearer. When the zipper 180 is in the open configuration the gusset 130 may be expanded to its full extent which may allow for the wearer to insert an appendage, such as a wrist, angle or neck into the seal 100. As is shown, the appendage of FIG. 3C would be a neck of the wearer. Each the extension 139 and the body 115 may be pulled away from the wearer to open the seal 100. One side of the extension is connected to the garment 10, and may prevent the zipper 180. As can be seen in FIG. 3C, the landing 127 may also extend down the chest of the garment, or extend to any desired location on the garment to increase the area in which the tab 125 can be connected to the landing.

Figure 3D:
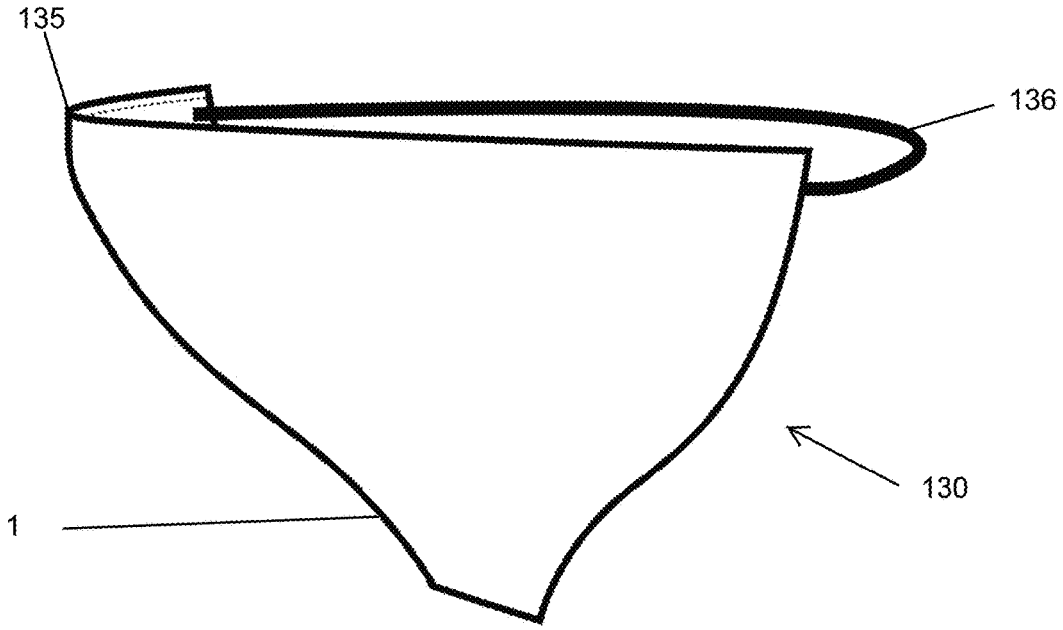
FIG. 3D illustrates an embodiment of a gusset with an elastic securing means.
Figure 3E:
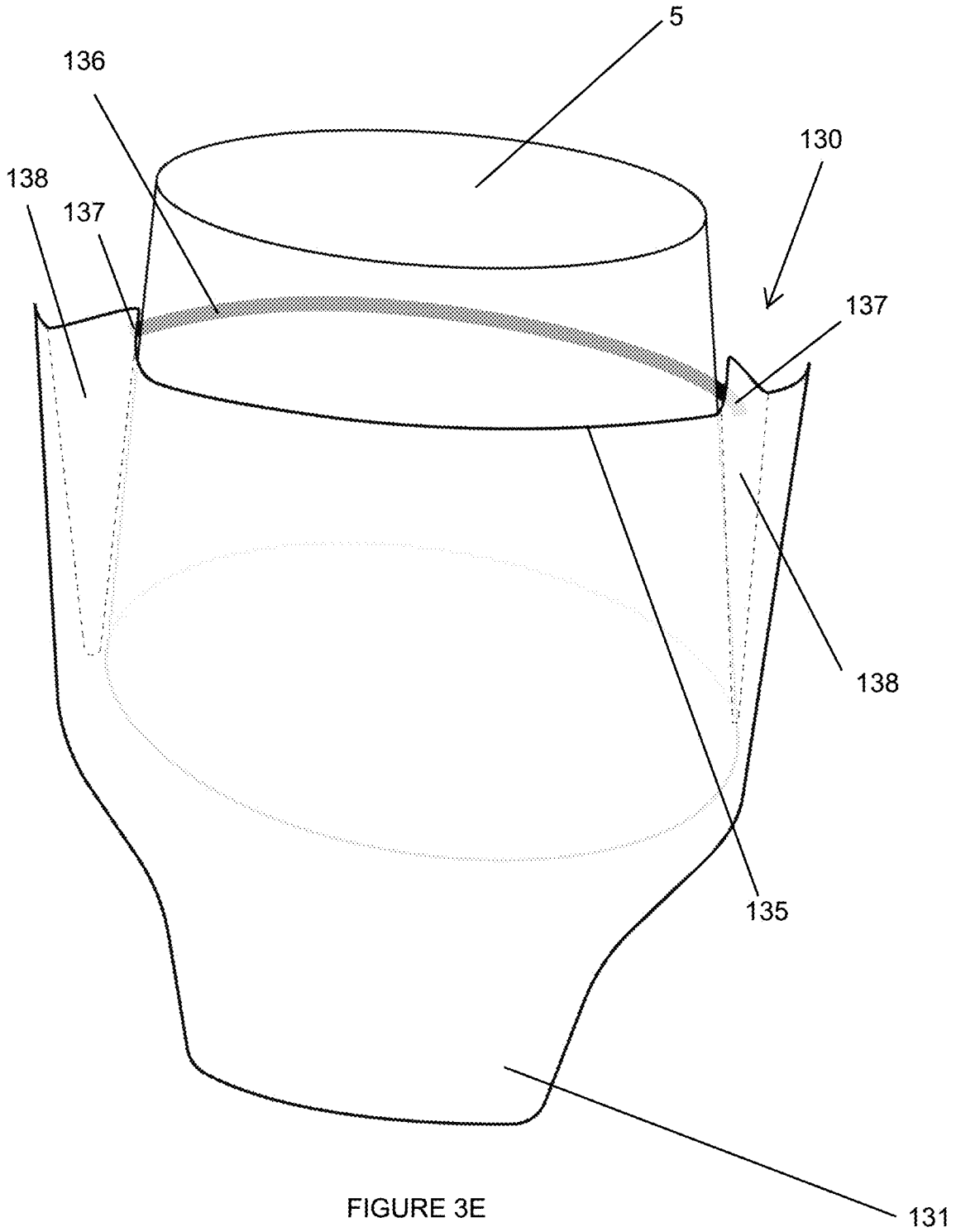
FIG. 3E illustrates an embodiment of a gusset similar to that seen in FIG. 3D mounted around a neck of a wearer.

FIG. 3D shows an embodiment of a gusset 130 which may be fitted to a garment 10 to form a portion of a seal 100, such as a neck seal or a limb extremity seal. It is preferred that the upper edge 135 of the gusset 130 is not connected directly attached to the garment 10. Optionally, gusset 130 further comprises a securing element 136 which can urge the gusset 130 to form an improved sealing configuration around the wearer. As can be seen in FIG. 3E the gusset 130 of FIG. 3D is shown in a mounted configuration, wherein the securing element 136 is around the neck 5 of a wearer and urges the gusset 130 to come into a sealing configuration with the neck. The edges of the gusset 130 are attached to the garment (not shown in FIG. 3E) and the gusset 130 can be biased where the securing element 136 is connected to said gusset 130. The sealing element may be fixed, fused, glued, bonded, welded, or otherwise permanently attached to the gusset 130 at predetermined bonding locations 137.

As the wearer mounts the securing element 136 around the neck, or appendage, the gusset 130 may be biased to form a sealing recess 138 or a sealing fold where the gusset is urged to conform to the neck, or appendage, of the wearer. This type of sealing arrangement can be used around any limb or body part of a wearer. Optionally, the sealing recess 138 can be reinforced and/or provided with an emboss, etch, or channel which can be deformed to encourage a fold or crease near to the bonding locations 137. Said emboss, etch or channel may be formed when the gusset 130 is made, or may be imparted to the gusset 130 after formation by a cut, laser, stamp, press or any other predetermined method to impart an indent, or deformation, which could assist with forming the sealing recess 138 around a wearer. Optionally, more than one emboss, etch or channel may be imparted to the gusset 130, and may also be used to direct fluids in a desired direction when in use. The sealing recess 138 may conform generally to the shape of the wearer to form a sealing engagement therewith.

Figure 3F:
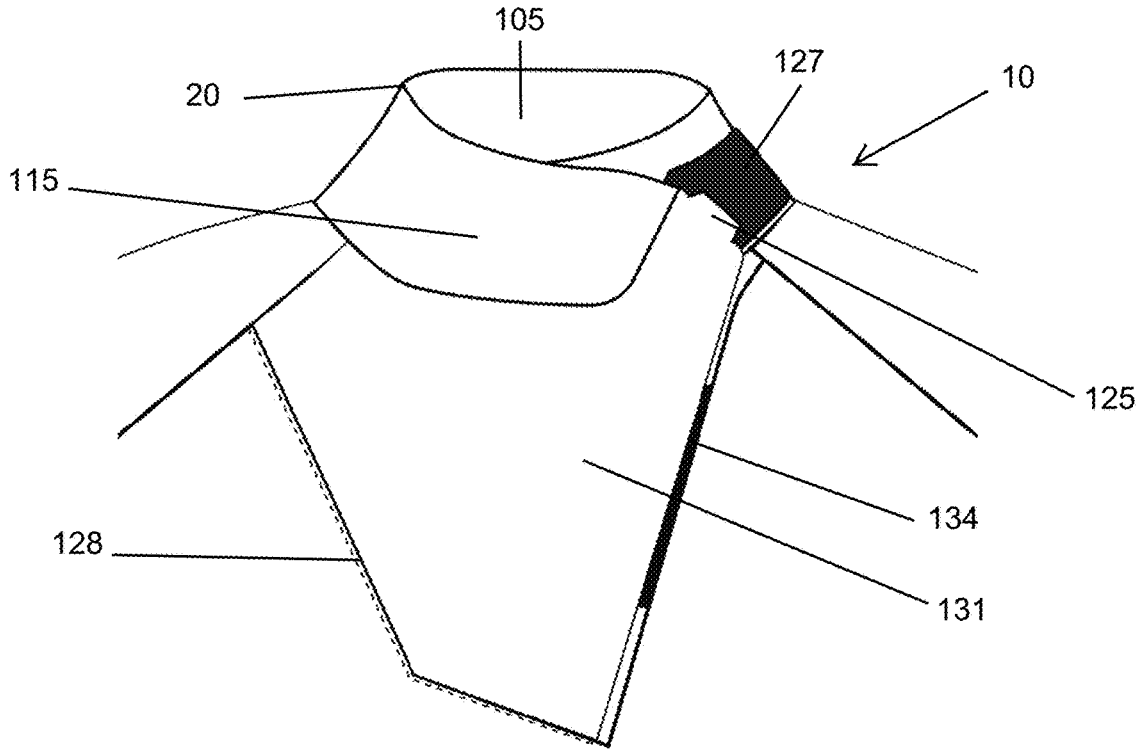
FIG. 3F illustrates an embodiment of a front view of a garment with a further gusset design in a closed configuration.
Figure 3G:
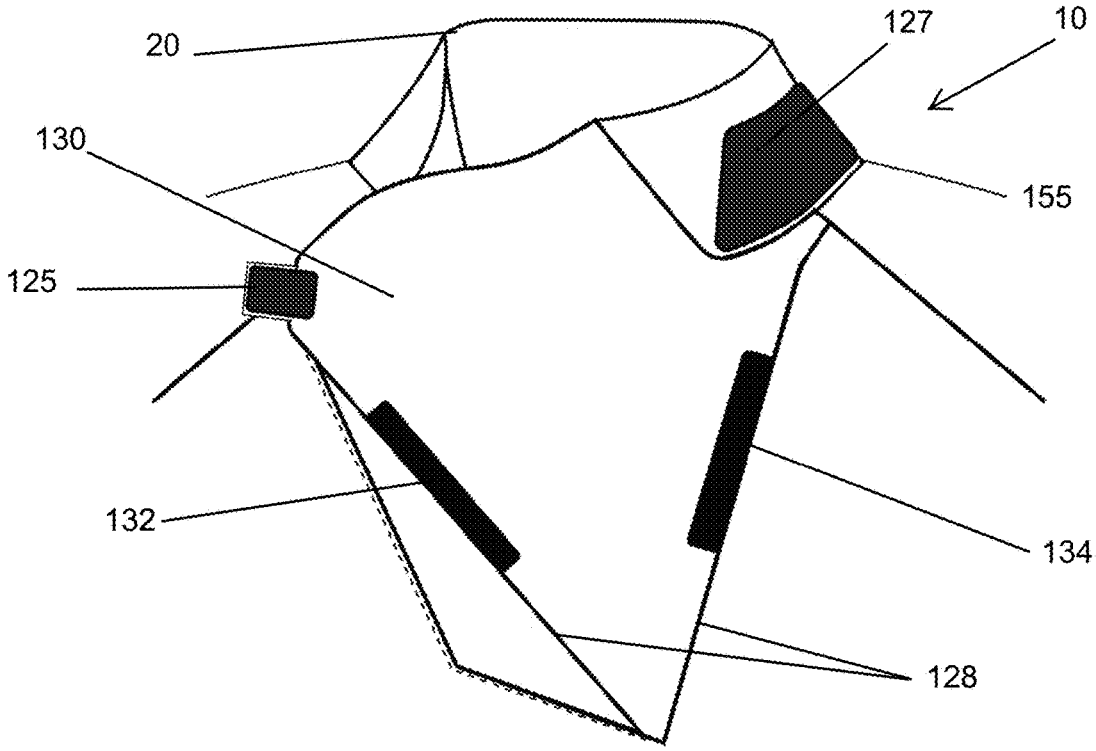
FIG. 3G illustrates an embodiment of the garment of FIG. 3F in an open configuration.

Referring to FIGS. 3F and 3G, there are shown embodiments of a garment with a neck seal 100. The garment 10 is shown in a closed configuration and an open configuration in FIGS. 3F and 3G, respectively. The seal 100 is formed with a gusset 130, and a gusset cover 131 which can extend across the breast of a wearer and a tab 125 connected to the gusset cover 131 of the neck seal 100, which can be connected to the securing means 155 on the landing 127. The gusset cover 131 may be formed from a material which is similar to adjacent portions of the garment 10, or may be formed from a stretchable and/or durable material such that the gusset 130 may be flexed and manipulated into a sealing configuration with the wearer. The gusset cover 131 may be connected to the gusset 130 at one edge, and the other or continuous edge of the gusset may be connected to the garment. The gusset cover 131 may overlap a majority of the gusset when in a sealing configuration (FIG. 3F). The gusset 130 may be adapted to fold over on itself such that the gusset securing means 132 can be mated with a corresponding gusset securing means 134. The body 115 may be connected with, or integrally formed with the gusset cover 131. It may be preferred that the gusset 130 is formed with a durable flexible material which can be used to form a seal. Where the gusset 130 is connected with the garment 10 and/or the gusset cover 131, the connection is preferably sealed at a gusset seam 128 to reduce or prevent fluid ingress. For example, seam tape or another sealing layer may be applied to cause a liquid tight seal or the like. In yet a further embodiment, it will be appreciated that any gusset 130 discussed herein may be connected with a gusset cover 131 at one edge or to the garment in any desired fashion. Having the gusset 130 connected with the gusset cover 131 and the garment 10 may provide for a larger opening to place through a body part more comfortably or more easily.

The gusset cover 131 may function in a similar manner to that of the extension 139 and allow for the covering of a zipper (not shown), and assist with a correct placement of the tab 125 on the landing 127.

In an unillustrated embodiment, garments 10 fitted with a seal 100 may have a removable gusset. If the gusset is removable, the gusset may be removably clamped or attached to the garment. In this way gussets can be varied for comfort, or removed for applications which do not require a liquid seal to be formed.

Figure 4:
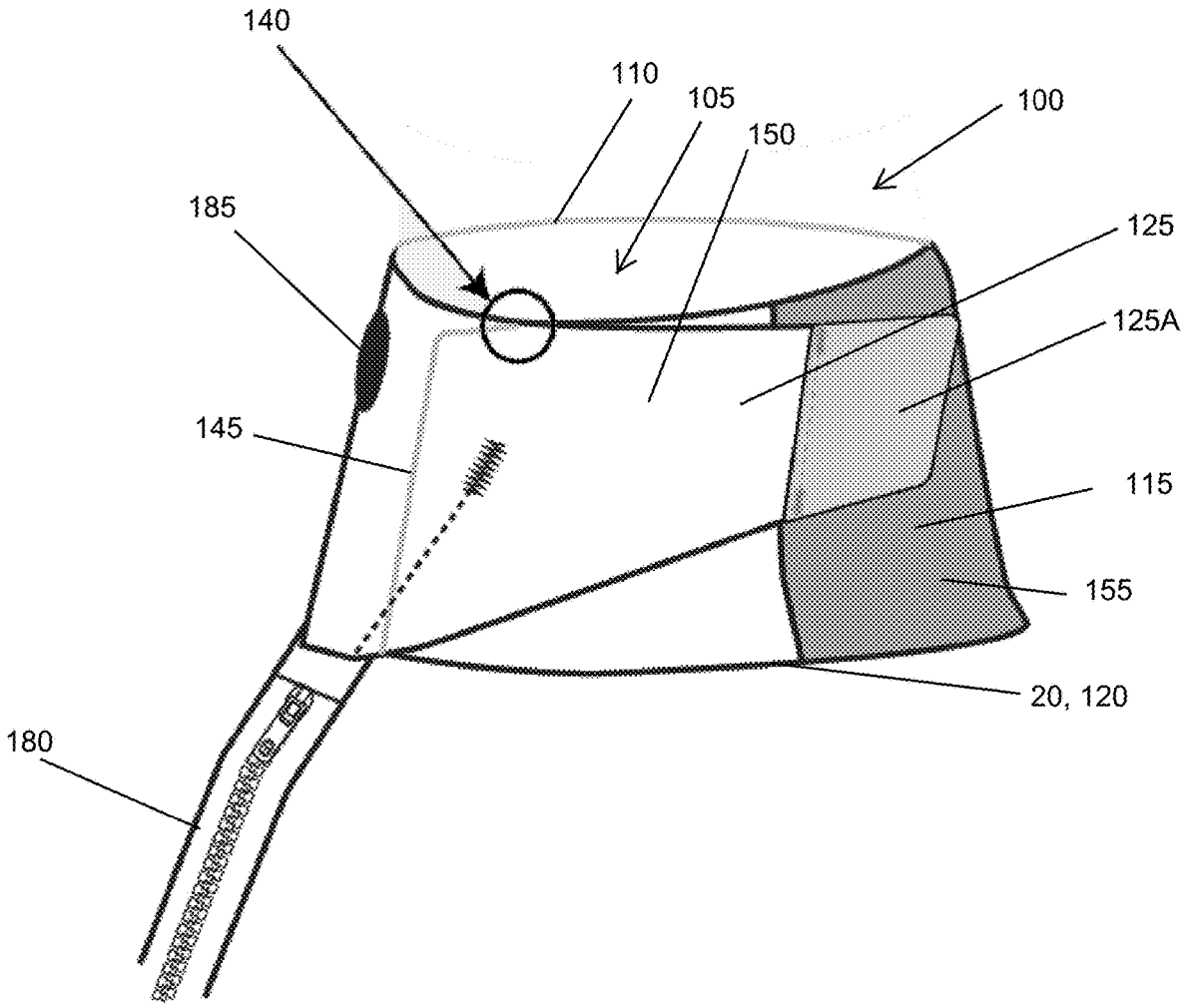
FIG. 4 illustrates a side view of an embodiment of a neck seal which may provide for improved comfort.
Figure 5:
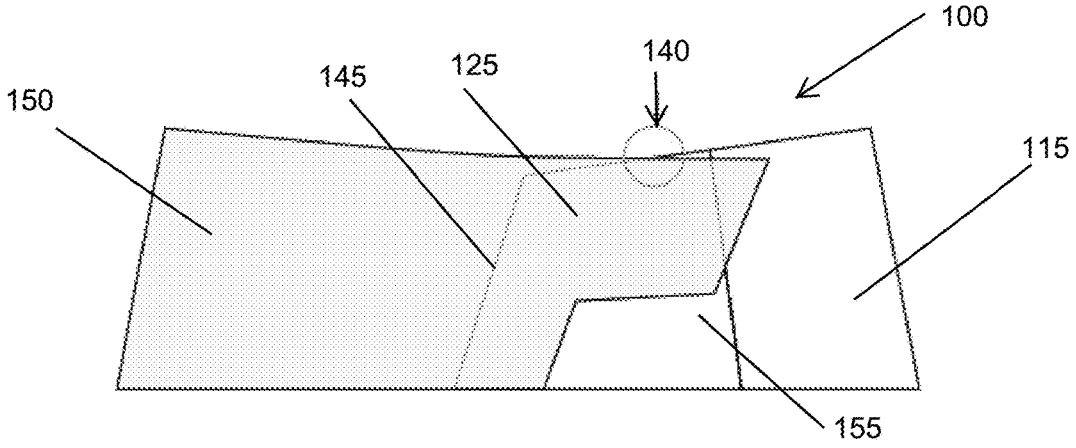
FIG. 5 illustrates a front view of an embodiment of a neck seal which can be fitted to a garment.

Referring to FIG. 4, there is illustrated an embodiment of a seal 100 which is disposed on a garment 10. The tab 125 is shown as being fixed to a portion of the body 115 and forming a mating relationship therewith. The crossing location 140 in which the tab 125 crosses over the first end of the body 115 is formed to provide a seal and also improve the comfort of the seal compared to conventional seals when in a sealing configuration. As is shown, the first end 145 of the body 115 and the tab 125 are sloped or angled downwardly relatively in an opposing manner such that the first end 145 can be covered at least in part by the tab 125 (also see FIG. 5). In this way, the seal may be configurable such that the second end 150 of the body 115 does not cover over the first end 145, and in such a configuration a superior seal may be formed. Further, this may also improve the comfort of the seal when in use as the thickness of the seal 100 is generally restricted from increasing from overlapping layers, or double backing on the garment. Double backing may occur in circular or cylindrical seals, as the material lay fold over itself. In addition, the overlapping portions of the seal may have a relatively clean edge around the upper edge of the seal 100, such that a desirable seal can be formed.

The tab 125 may be formed with a polymeric material or be formed with a polymeric coating which provides a tactile or textured surface to allow for easy identification of its location and to assist with gripability of the tab 125. It is preferred that the hooks of a traditional hook and loop fastener system are disposed on the tab to avoid abrasion against the hooks during use if the opposite configuration were used. Optionally, the tab 125 is formed in part with an elastomeric material with a gripable portion 125A such that the elastomeric portion of the tab 125 can stretch at least in part to form a tighter seal and the gripable portion 125A can still be utilised to manipulate the tab 125. The tab 125 may be fixed to the body 115 at the second end 150. The tab 125 may be stitched, sewn, glued, bonded, welded, adhered or affixed with any desired method. Preferably, any connection point between the tab 125 and the second end 150 of the body 115 is provided with a watertight seal.

At least a portion of the gusset 130 may extend above the neck opening 20 as is seen in FIG. 3A wherein a portion of the seal 100 is depicted as transparent to view the gusset 130. In use it is likely that the material to form the seal 100 is opaque, however transparent materials may optionally be used.

A tab anchor 185 may be optionally provided on the outside of the body 115 of the neck seal 100 which can be mated with the neck tab 125. Tab anchor 185 is used to attach to the neck tab 125 when in an open configuration such that the location of the neck tab 125 can be controlled. In another embodiment, tab 125A can fold over itself such that the hook fastener on the underside can be removably attached to the loops of the tab anchor 185.

Figure 7A:
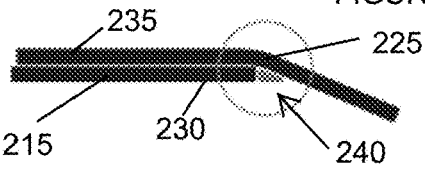
FIG. 7A illustrates a section view of an embodiment of a cuff seal with a uniform thickness.
Figure 7B:
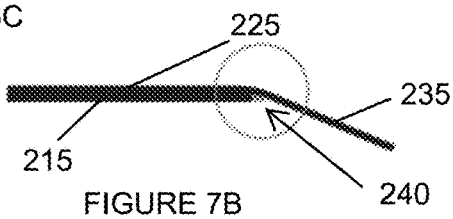
FIG. 7B illustrates a section view of an embodiment of a cuff seal with different thicknesses at the ends.
Figure 7C:
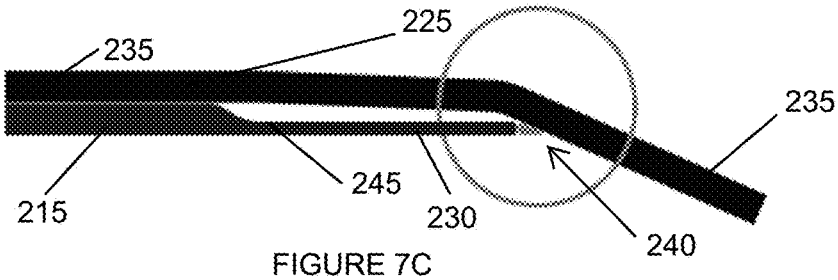
FIG. 7C illustrates a section view of an embodiment of a cuff seal with an embossed portion.
Figure 7D:
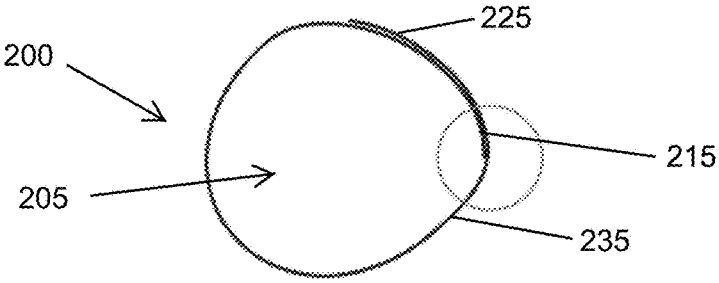
FIG. 7D illustrates a section view of an embodiment of a cuff seal with an embossed portion.
Figure 7E:
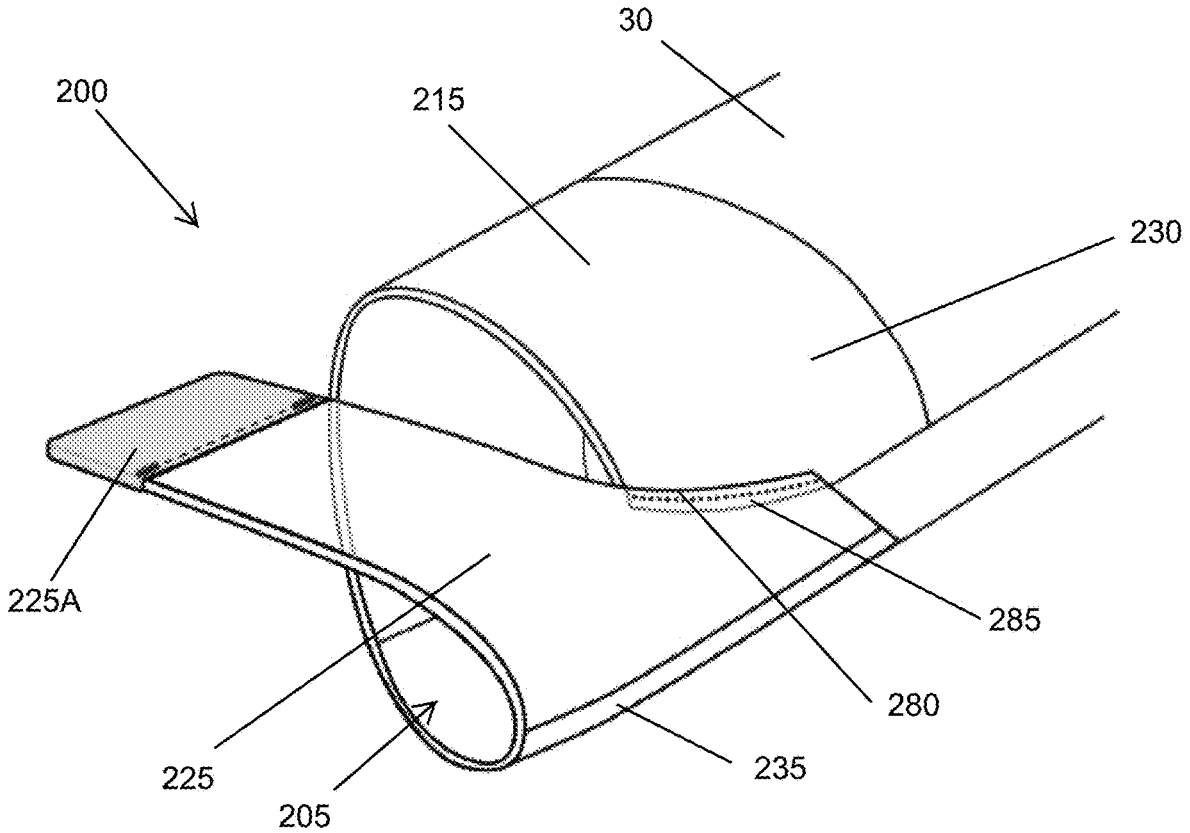
FIG. 7E illustrates an isometric view of a cuff seal or wrist seal which can be fitted to a garment in an open configuration.
Figure 7F:
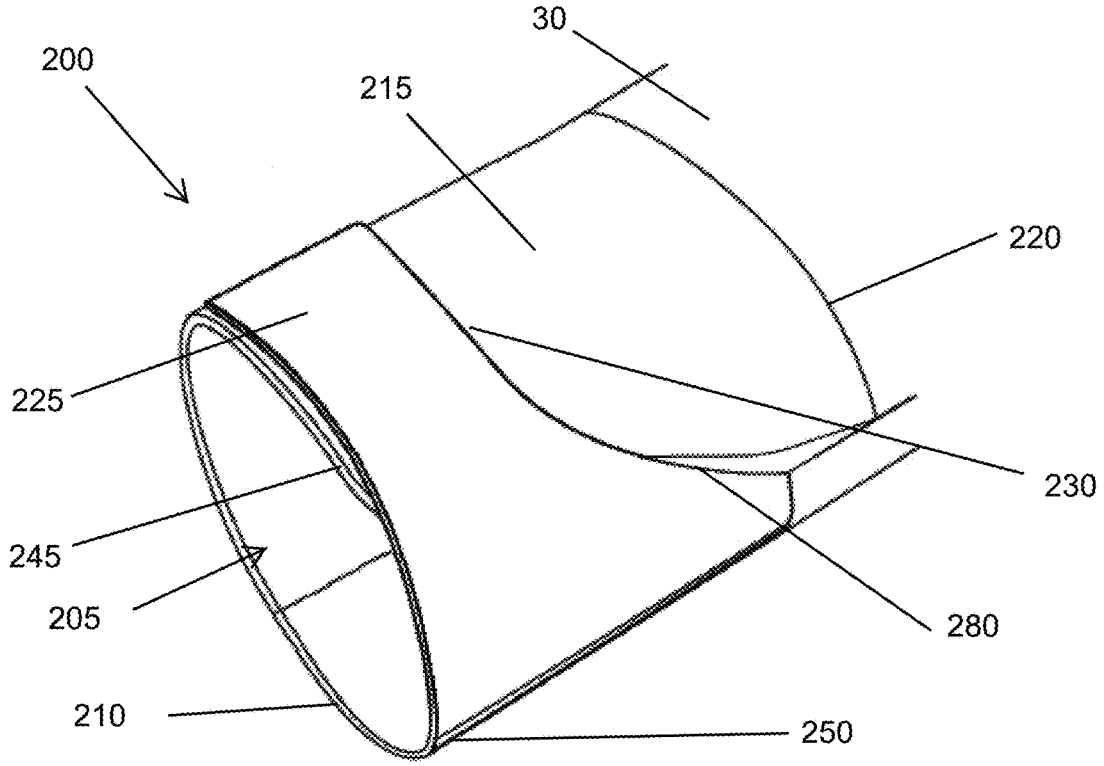
FIG. 7F illustrates an isometric view of a cuff seal or wrist seal which can be fitted to a garment in a closed configuration

Referring to FIGS. 7E and 7F, there is illustrated an embodiment of a cuff or wrist seal 200 which can be fitted to a garment 10 to assist with reducing ingress of fluids into a garment. The wrist seal 200 provided may be constructed from a flexible material comprised of a substantially waterproof textile composite. The wrist seal 200 is fixable to the end of a respective sleeve 30 of a garment 10. Each sleeve 30 of the garment 10 may comprise a different seal 200, however it will be appreciated that each of the seals 200 may be the same seal or may be adapted to be changed depending on the desired application.

Figure 6A:
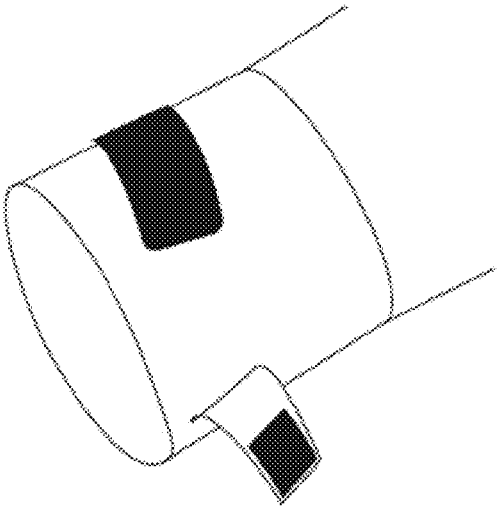
PRIOR ART FIGURE 6A
FIG. 6A illustrates a sectional view an embodiment of a wrist cuff of the prior art in an open position.
Figure 6B:
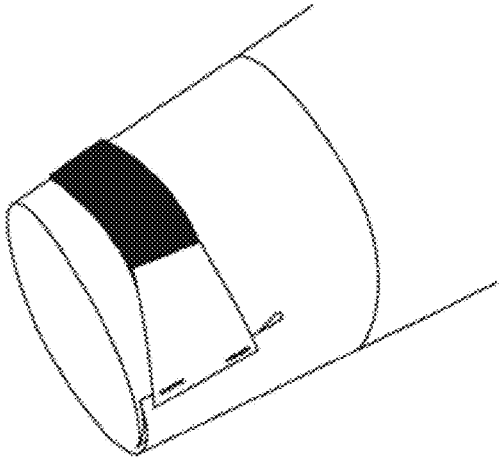
PRIOR ART FIGURE 6B
FIG. 6B illustrates a sectional view of an embodiment of a wrist cuff of the prior art in a closed position.
Figure 6C:
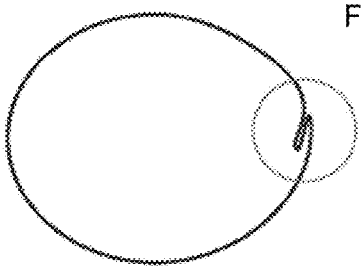
PRIOR ART FIGURE 6C
FIG. 6C illustrates an embodiment of a wrist cuff of the prior art in a closed position wherein fluid channels are formed.

Examples of prior art wrist cuffs are illustrated in FIGS. 6A to 6C. These images show a conventional hoop and loop sealing mechanism, which results in a folded and overlapped portion of the cuff which allows fluid to ingress relatively easily. The cuff of the prior art is shown in an unfastened position in FIG. 6A. The folded and overlapped portion of the cuff is relatively thicker than the rest of the cuff which can allow for ingress of fluids as can be seen in FIG. 6B. As the cuff is folded and secured, the configuration depicted in the circled region of FIG. 6C is formed, which provides a gap which is defined by the thickness of two layers of fabric used to form the cuff, or potentially even thicker if the cuff comprises a hem. The gap may also be larger than two layers of the cuff fabric as the folds may form a loop or bulbous end which can increase the size of a gap formed.

Similar to the neck seal 100, the wrist seal 200 comprises a body portion 215 which has a free edge 210, wrist edge 212 and a connection edge 220. Several embodiments of the wrist seal 200 are illustrated in FIGS. 7A to 7D. FIG. 7A illustrates an embodiment of a seal 200 in which the body portion is of a continuous thickness from the first end 230 to the second end 235. FIG. 7B illustrates another embodiment of a wrist seal 200 where the first end 230 is relatively thinner than the second end 235, such that the gap 240 formed by overlapping the second end 235 on the first end 230 is reduced compared to the embodiment of FIG. 7A. This can further reduce the potential for fluids to ingress into the garment 10. Referring to FIG. 7C, there is shown yet another embodiment of a portion of a wrist seal 200, which has a compressed region 245 at the first end 230. The compressed region 245 may be an embossed region or a heat pressed region or otherwise a region which is made relatively thinner by a forming process, compared to the second end 235. The second end 235 will generally conform to at least a portion of the profile of the compressed region 245 when in use, and may further assist with reducing the gap 240. It will be appreciated that FIG. 7C is for illustrative purposes to more clearly view compressed region 245. It is preferred that the gap 240 is of a size that will essentially limit or prevent water from passing into a garment via the wrist seal 200. FIG. 7D shows a sectional view of the wrist seal 200 wherein gaps which are formed in conventional cuff are not present and the overall outer profile of the seal is relatively thinner and more flush (or level) with the wrist of a wearer. This can provide for a superior seal compared with other cuffs used in conventional garments.

For example, if the seal 200 is formed with a neoprene of around 3 mm continuous thickness for the seal, a gap of which may be larger than 1 mm may be formed, depending on the tightness of the seal made by the wearer. As such, it may be preferred that at least the first end 230 is formed with a thickness of 2 mm or less to reduce the gap 240 to less than 1 mm, and thereby reduce the potential of ingress of fluids. Forming the compressed region, as seen in FIG. 7C, may be advantageous in this regard as a uniform thickness material may be used to form the seal 200 which can then be modified as desired by the compression process. Further, moulding or compressing a unitary body 215 material can reduce the chance of seal failure relative to attaching a second material to form the first end 230 of the seal 200.

Turning back to FIGS. 7E and 7F, the free edge 210 can define an opening 205 of the seal 200 which a fit around the wrist of a wearer. The connection edge 220 being fixable to the sleeve of the garment 10 by any predetermined method, such as sewing, gluing, bonding, welding, clamping, buttoning, press fitting, or any other method known in the art. The connection between the sleeve 30 and the seal 200 is preferably provided with a water proofing means, such as a hot melt tape or the like in the case of a permanent seal. Optionally, the connection may be waterproofed by a dipping process to cover the connection with a water-resistant polymer. If the seal 200 is removable or replaceable, the seal may have a biasing lip which may clamp of secure the wrist seal 200 in a desired location.

The seal 200 is configured to fit tightly around the wrist of a wearer by securing the tab 225 of the wrist seal 200 to the first end 230 of the body 215. The tab 225 can be releasably attached to the first end 230 of the seal 200 via any desired attachment means as has been described herein, such as the securing means 155 used for tab 125 wherein any one of as a button, hook and loop fastener arrangement (including ALFA-LOK™ style fasteners), a stud, a press lock, buckle, or any other predetermined attachment means. The tab 225 may be integrally formed with the second end 235 of the body 215, or may be fixed or connected to the second end 235. The second end 235 may be formed with a width which is larger than the first end 230, such that the second end 235 can overlap a portion of the sleeve 30 when forming a seal. Optionally, the tab 225 can be relatively wider than that of the first end 230 to achieve the same function.

By allowing the seal to be secured around the wrist via the tab, the seal 200 can be used for a range of wrist sizes, which provides a significant advantage with regards to comfort and the ability to seal. In one embodiment, the seal 200 may be fixed to the sleeve 30 at only a portion of the connection edge. This may allow for the tab 225 to overlap a portion of the first end 230 of the seal, and also overlap a portion of the sleeve 30 as is observed in FIG. 7.

The free edge 210 defines a first opening which forms the outermost edge of the seal 200 and is configured to fit tightly around the wearer's wrist to provide a substantially water-tight seal between the skin and said seal 200. The free edge 210 may be adapted to be stretchable at least in part to provide a tight, yet comfortable seal between the seal 200 of the garment 10 and the wearer.

The tab 225 may be formed with an arcuate portion 280 as illustrated or may be formed with a tapered or angled shape. The arcuate portion 280 allows for a more comfortable fit between the wearer and the seal, while also positioning the tab 225 such that it is disposed in a natural position around the wrist when in a sealing configuration. The seal can be configuration to be in a sealing configuration, in which the seal provides a seal against ingress of fluid around the wrist of the wearer, an open configuration, such as when the seal does not have the tab 225 engaged with the first end 230 of the seal 200, and a closed configuration, in which the tab 225 is secured to the first end 230 without providing sealing engagement with the wrist of the wearer.

The arcuate portion 280 may be provided with a stitching line or other reinforcement means 285 to assist with maintaining the shape of the arcuate portion 280. Optionally, a rubber or polymer may be applied to the arcuate portion 280 to improve the tear strength of the arcuate portion 280, or to increase the rigidity of said arcuate portion 280.

In another embodiment at least the tab 225 of the seal is stretchable up to at least 100% elongation around the wrist (circumference of the seal 200). In a further embodiment the body 215 and tab 225 is stretchable along the length of the seal between the first opening and second opening in order to allow improved movement of the wrist when in use. Optionally, the body 215 may stretch in more than one axis to allow for flexibility of the seal when in use. For example, the body may stretch in the direction around the wrist, or may be stretchable in the axial direction relative to the openings of the seal 200.

The seal may be formed from a substantially waterproof textile composite or may comprise one or more substrates selected from the following group; a stretchable woven, knitted textile, a non-woven textile, and a stretchable knitted textile. In one embodiment, the materials used to form the substrates may comprise synthetic yarns, such as nylon, polyester or polypropylene and stretchable elastane yarns. Optionally, rubbers, films or linear substrates may be used to form the seal or a portion thereof. Any of the materials may have one or more functional coatings applied thereto to allow for a desired abrasion resistance, water repellency, roughness or smoothness. It is preferred that the seal is resistant to tearing compared to the rubber seals known in the art, and may be formed from one or more layers of textile, film, polymer sheet, rubber, vacuum formed material or any combination of the aforementioned. Optionally, the seal 200 comprises a waterproof coating layer positioned on the inside face of the seal so that it directly contacts the wearers body and/or the sleeve of the garment to reduce the potential for the seal 200 to slip or move out of a sealing configuration when in use. In yet another embodiment the waterproof coating layer is generally smooth to improve sealing between the seal and the wearer. Optionally, one or more functional coatings may be applied to seal, textile or textile composite, in which the functional coatings may be a waterproof, water-resistant, hydrophilic, abrasion-resistant or UV resistant coating. Other coatings may also be optionally applied.

In yet a further embodiment, the waterproof coating layer may be formed from a substantially water impermeable polyurethane film lamination that provides adequate stretch modulus and recovery to fit tightly around the wearers body to provide a water-tight seal. The polyurethane film may be formed from at least one of the following materials; a polyether-polyurethane film, polyester-polyurethane and/or polycarbonate-polyurethane or composite thereof. Optionally, the seal 200 may be moisture vapour permeable to allow moisture built up within the garment from perspiration to escape. In another embodiment the seal may be formed with a thickness in the range of 0.01 mm and 1 mm.

In yet another embodiment, the free edge 210 is formed with a thickness which is thinner than the body 215 of the seal, such that the edge 210 can form a tighter seal with the wearer without reducing the overall comfort provided by the seal 200. The thickness of the edge 210 may be in the range of 0.01 mm to 0.1 mm and graduate to the thickness of the body which may be up to 5 mm in thickness depending on the construction. For example, if the body 215 uses a closed cell foam the thickness of the body may be in the range of about 0.3 mm to 5 mm, or about 0.5 mm to 5 mm. In another embodiment, free edge 210 may be compressed with a heat process or an embossing process such that the free edge can be of a desired thickness. This is advantageous if the body 215 is formed from a material with a uniform thickness, which could reduce the overall production costs. For example, a 2 mm neoprene material may be used for the body 215, and plastically deformed and compressed to obtain a lower profile at the free edge, in the range of 0.5 mm to 0.1 mm.

Preferably, the seals 200 can be bonded to a hot-melt waterproof seam sealing tape or adhesive film to form a watertight seal between the connection edge 220 and the sleeve 30. The ability to bond with hot-melt seam sealing tapes allows for easy mass production of the garments using conventional sealing techniques known in the art, it also allows for ease of replacement or repair of damaged seals 200 by the application of hot-melt adhesive seam tape or patches.

The seals 100, 200 may be padded or reinforced provide for a more comfortable fit and provide for a tighter abutment between the wearer and the seal. Any padding provided is preferably a waterproof or water-resistant material to reduce the potential for liquids to enter via a seal 100, 200. In some embodiments, the wrist seal may be suitable fur use as an ankle seal, a bicep seal or a thigh seal. The seals may be used to form a liquid-tight fit around any desired limb of a wearer.

Preferably, the material forming the seal 200 is stretchable with enough stretch such that the overall seal size can be minimised in an at rest position and also reduce a feeling of bulkiness at a seal. If a less stretchable material is used to form the seal, then a relatively longer seal may be required to allow adequate expansion of the opening to allow the user to enter and remove their wrist or head from the garment 10.

In another embodiment, seal 100 and/or seal 200 are formed by joining two or more panels of waterproof textile along to form the respective bodies 115, 215. Seam joining the textile are constructed to be substantially watertight. Seam tape or seam material may be applied to both the inner and outer sides of the seals 100, 200 in order to provide additional reinforcement to the seams forming the bodies.

In a further embodiment, the seals are formed by constructing the seals as separate elements and coating or laminating a waterproof coating layer onto the seals and a portion of the garment thereby fixing the seal to the garment 10. This can assist to form a desired seal shape, and may also be used to form a superior sela relative to the use of seam tapes.

In some embodiments, the seal can be trimmed by the user around the circumference of the upper edge in the case of a neck seal 100, or the free edge 220 in the case of a wrist seal 200. This may also be advantageous if a portion of the edge 120, 220 However, it will be appreciated that the seals 100, 200 may be configured to accommodate variable neck and limb sizes without permanent modification.

The seal may be provided with a reinforcement material which may be comprised of a knitted or woven textile, polymeric film or coating or fabric and film composite applied the to the seal by means of laminating, bonding, printing, stitching, gluing or other process. In a preferred embodiment, said reinforcement material is an elastomeric polyurethane film with a thickness between 40 μm and 300 μm comprising a hot-melt adhesive on one side that is used to bond the film to the seal.

Figure 8:
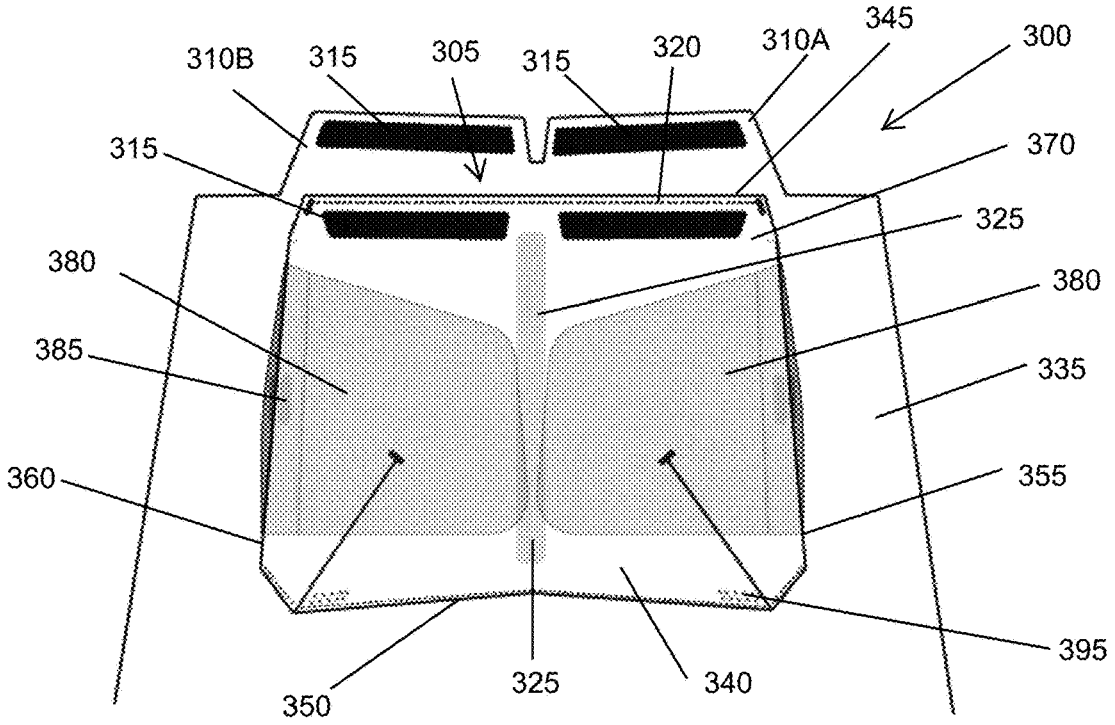
FIG. 8 illustrates a front view of an embodiment of a pocket system which can be included with a garment.

Referring to FIG. 8 there is illustrated an embodiment of a pocket which may be formed with a garment 10. The pocket 300 may generally be disposed on the front side of a garment between the neck opening 20 and the hem 40. Any number of pockets 300 may be formed to allow for any desired configuration. The pocket 300 illustrated comprises a primary receptacle 370 and two minor receptacles. The primary receptacle 370 is accessible via an opening 305 which is coverable or sealable by flap 310. Opening 305 may comprise a hem, stitch, coating or other reinforcing 320 to reduce damage from opening, closing or abrasion when in use. The pocket 300 may have more than one flap 310 to allow for access to a portion of the pocket, or restrict entry into the pocket in a desired manner. The pocket 300 has an upper edge 345, lower edge 350 and a right edge 355 and left edge 360. Each of the sides may be defined by the shape of the front panel 340. The bottom side of the pocket 300 may be angled or sloped such that any fluids which enter into the pocket can be diverted to apertures 395. This also provides the benefit of allowing articles deposited into the pocket to move towards the corners of the receptacle, which may improve the ability to locate and retrieve said articles more easily.

The pocket 300 is formed with a front panel 340 which attaches to a rear panel 335. The rear panel 335 in some embodiments may be the front panel of the garment 10, or the rear panel 335 may be affixed to the front panel of the garment 10. Any desired bonding method may be used to attach the front panel 340 to the rear panel 335, such as stitching, sewing, gluing, bonding, welding or otherwise affixing the pocket together. In some embodiments, the pocket 300 may be removable from the garment 10 such that the pocket can be selectively used. The pocket 300 may be removably attached to the garment 10 by a releasable system. The releasable system may be at least one of; a hook and loop fastener, a snap lock, webbing, buckles, via ALFA-LOK™ type mating systems, or any other releasable or removable system. This can be advantageous as different pocket systems can be used with the garment 10 for different applications.

Disposed between the front panel 340 and the rear panel 335 may be at least one minor receptacle 380. As shown in the representations, a pair of minor receptacles 380 are disposed between the front panel 340 and the rear panel 335. Each of the minor receptacles 380 are formed from either two sheets of material bonded or fixed together, or from a single sheet folded over and fixed together to make the receptacle 380. The openings of the minor receptacles 380 may be accessible at the left and right edges 350, 345 of the pocket 300. If minor receptacles 380 are accessible at the left and right edges 350, 345, the openings 385 may be the fixed to both the real panel 335 and the front panel 340 such that access to the minor receptacle 380 can be allowed while also sealing the edges of the primary receptacle 370. As is shown the minor receptacles 380 are positioned such that the openings 385 are positioned at the left and right sides of the pocket 300.

The lower edge 350 is preferably shaped to slope from a central portion to the apertures 395 at the corners of the pocket. This can assist with diverting liquids within the pocket to the apertures. Optionally, the pocket 300 may have tapered left and right edges 350, 345 such that the length of the lower edge is relatively longer than the length of the upper edge which may improve the carrying weight capacity of the pocket 300.

In a further embodiment, each of the openings 385 may be releasably closed with a fastener 390, a flap, a zip, a securing lip or any other desired closing means. The openings 385 of the minor receptacles may be biased to be in a closed position. A biasing means may be provided around the opening to close the opening when not in use which may reduce ingress of fluids. The biasing means may be provided in a tunnel formed at the opening which can include a deformable metal element or a plastically deformable element (not shown). Each of the minor receptacles 380 may be fixed only at their respective openings 385 to the front panel 340 and rear panel 335 which may allow for the receptacles to be displaced, rolled up, folded or inverted within the major receptacle 370. If the minor receptacles 380 are inverted they may be pulled inside out such that the volume of the major receptacle 370 is increased. This may allow for additional items to be received within the major receptacle 370. A binding (not shown) may be provided to hold the minor receptacles in a compact configuration when not in use or if more space within the major receptacle is desired.

The minor receptacles 380 may be fitted with a quick drying material, or a material which quickly wicks moisture. The minor receptacles 380 may also function as a hand warmer for the wearer without opening the major receptacle. The positioning of the minor receptacles 380 may function as hand pockets for the wearer, without requiring the wearer to place their hands through the opening 305 and enter the major receptacle.

A divider 325 can be disposed within the major receptacle 370 which can be used to separate the major receptacle 370 into two or more discrete receptacles. The divider 325 can be a hook and loop fastener system, for example, which is disposed within the pocket 300 as can be seen in a transparent view in FIGS. 8 and 9. The divider 325 may have a cover (not shown) provided within the pocket 300 to cover at least one half of the divider 325 when the pocket is desired to be one receptacle rather than one or more discrete receptacles which prevents mating between the two or more portions of the divider 325. More than one divider 325 can be disposed within the pocket 300. Each divider 325 may extend in any predetermined orientation to provide for a predetermined receptacle configuration. In a basic form, the divider 325 has two portions, one disposed on the front panel, and a second portion disposed on the rear panel which are aligned to allow for mating of the divider 325.

Dividers 325 can be used to separate the pocket 300 such that wearers can select the location to store items when in use. This can also allow for mounting of pocket protectors or pocket inserts, and the divider may be configured to mate with at least a portion of the pocket insert to retain the pocket insert in a fixed or desired location. Pocket inserts may be fitted with a corresponding hook and loop fastener system which mates with the divider 325.

As can be seen in FIG. 8, the pocket 300 comprises a flap 310 which is split (310A, 310B) to correspond with the discrete receptacles formed by the divider in the major receptacle. This configuration of the flap 310 can also allow for ambidextrous use of the pocket without opening the entire flap or closing mechanism of the pocket 300.

Optionally, the minor receptacles 380 may be attached to the divider 325 within the major receptacle 370. This may allow for the minor receptacles to be supported at both the opening and the deepest part of the receptacle, as can be seen in the representation of FIG. 8.

Drainage apertures 395 may be provided near to the bottom of the pocket 300 to allow for fluids to drain from the pocket if water or other liquids enter. These apertures 395 may be provided for each receptacle, or may only be provided for the primary receptacle 370. Other drainage means may also be provided, such as a wicking means or other means to direct liquids from the pocket 300. The outer surface of the pocket is preferably abrasion resistant, or is coated with a non-slip material. Optionally, the front panel and/or the rear panel are high visibility materials such that a wearer can easily view items within the pocket 300.

Figure 9:
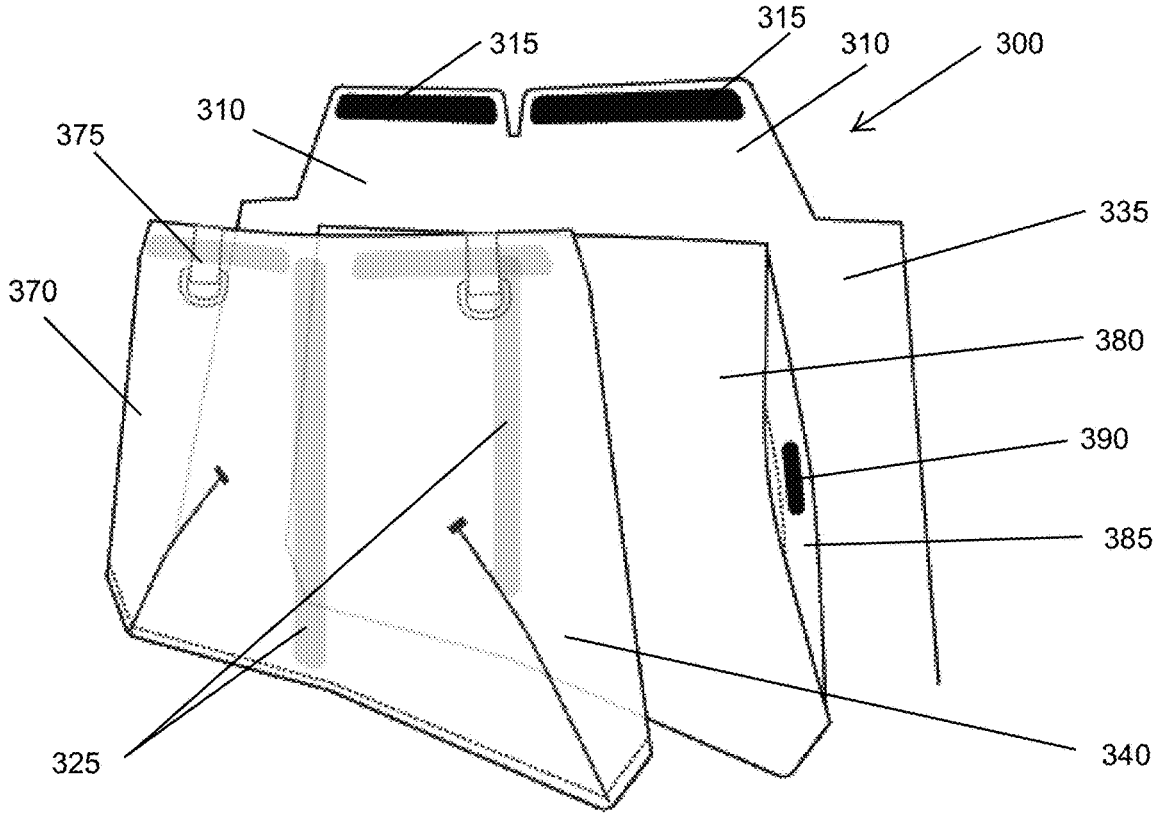
FIG. 9 illustrates an exploded view of an embodiment of a pocket system which may be included in a garment.

FIG. 9 illustrates an exploded view of the pocket 300 with a primary receptacle 370 and minor receptacles 380 shown as individual elements. The front panel 340 further includes anchor means 375 at the upper edge 345 of the panel. The anchor means may provide for a mount for keys, ropes, clips or other devices. The anchor means 375 may be of any predetermined configuration and is not limited to a D-ring and tether as is illustrated. As can be seen, the front panel and the rear panel may comprise a respective attachment means 315 which can be mated. The attachment means 315 can be any means used to releasably attach the front panel and the rear panel, such that the opening 305 is closed or covered. In an unillustrated example, the attachment means 315 may be a zipper rather than a hook and loop fastener arrangement. It will be appreciated that the attachment means 315 may be any means which can be used to close or seal the opening 305.

Embodiments of different pockets are also illustrated in FIGS. 1 and 2. Referring to the pocket of FIG. 1 there is provided a pocket which is accessible via a zipper 330. The front panel has been sealed or fixed with the garment 10 at each of its edges and the pocket being accessible via a zipper 330 which extends down the middle of the pocket 300. It will be appreciated that the zipper 330 may be disposed anywhere on the pocket 300, or any be provided at an edge if desired. Having the zipper 330 within the middle of the pocket allows for ambidextrous access to the pocket 300 as the wearer can insert a left hand and/or right hand across the garment and into the pocket when in use. This provides a reliable pocket which can be utilised by any person.

The inside of the receptacle 370 is shown as being disposed with attachment means in adjacent to the zipper 330. The attachment means may be affixed to the pocket with any desired means, such as sewing, gluing, bonding or may be integrally formed with the panels 335, 340. Inside the receptacle 370 is defined by the space between the front panel 340 and the rear panel 335. One of the front panel 340 and the rear panel 335 may be fitted with attachment means 315 and the other panel is fitted with a corresponding attachment means 315, and are adapted to flatten the pocket 300 when the pocket 300 is not in use and reduce difficulty moving in the garment 10. Further, temporarily fixing the pocket 300 toward the body of the wearer may reduce potential for the pocket 300 to snag or catch on sailing equipment or other objects when worn. This is of significant advantage when wearing the garment in active sporting events or when wearing the garment in potentially hazardous or dangerous spaces. The attachment means 315 may be disengaged as the wearer pulls the zipper 330. If the wearer pulls the zipper relatively downwardly the attachment means may remain intact if desired. However, pulling the zipper downwardly and outwardly can disengage the attachment means.

The lower edge of the pocket may have an angle to direct fluids which may enter into the pocket 300 towards the apertures to drain from the pocket. Optionally, the apertures may be shaped to provide for a one-way direction of fluids out of the pocket 300. One-way fluid direction may be achieved by the used of a membrane, a filter, or shaping the apertures with a tapered profile to direct fluid out of the pocket 300.

Pockets may be provided with at least one reinforcement element 365. The reinforcement element may be at least one of; a dart, a thicker material, a ribbing, an abrasion resistant coating, a coating, a functional coating, a texture, or any other structural reinforcing means. Referring to FIG. 2, there is shown a pair of reinforcing elements 365 which can be used to reduce tearing of the front panel 340 of the pocket 300. Further, the reinforcement elements 365 assist with providing a desired shape to the pocket and may assist with biasing the pocket towards the wearer when in use. Front panel 340 may also be folded or formed to allow for a region of the pocket to move into an expanded configuration when items are within the pocket 300, or when the pocket front panel 340 is pushed out from within the receptacle.

Although the invention has been described with reference to specific examples, it will be appreciated by those skilled in the art that the invention may be embodied in many other forms, in keeping with the broad principles and the spirit of the invention described herein.

The present invention and the described preferred embodiments specifically include at least one feature that is industrial applicable.

The invention claimed is:

1. A seal for a garment, the seal comprising:

a body portion, the body portion having an upper edge, a lower edge, a first end and a second end, the lower edge being configured to be fixed to the garment at an opening; and a gusset arranged below the body portion, the gusset comprising first and second side edges and an upper edge extending between upper ends thereof;

wherein the second end of the seal comprises a tab which is adapted to cover a portion of the first end to form a first sealing portion; and the gusset is adapted to fold or deform into a second sealing portion extending below the first sealing portion;

further wherein the seal has an open configuration when the tab is distal from the portion of the first end, and a sealing configuration when the tab covers the portion of the first end to form the first sealing portion and the gusset is folded or deformed into the second sealing portion.

2. The seal as claimed in claim 1, wherein the tab is fixed to the second end of the body.

3. The seal as claimed in claim 1, wherein the tab comprises an attachment means adapted to secure to a corresponding attachment means on the body of the seal.

4. The seal as claimed in claim 1, wherein the tab and the first end are angled downwardly relative to a portion of the upper edge that is proximal to the second end, such that the tab and the first end converge at a location which is relatively lower than the portion of the upper edge.

5. The seal as claimed in claim 1, wherein the seal is a neck seal configured to reduce ingress of fluids around the neck of a wearer.

6. The seal as claimed in claim 1, wherein the seal is formed at least in part from a closed cell foam selected from the following group; polyurethane foam, EVA foam, a two layer composite material, neoprene foam, styrene butadiene rubber foam, wherein the closed cell foam is laminated to at least one of a knitted textile and a woven textile.

7. A garment including the seal of claim 1, wherein the lower edge of the body portion is fixed to an opening of the garment.

8. The garment of claim 7, further comprising a pocket comprising:

a front panel connected to a rear panel, each of the front panel and the rear panel providing a respective pocket inner surface, the pocket inner surface of the front panel and the pocket inner surface of the rear panel at least partly defining a major receptacle;

an opening to access the major receptacle; and a fastener arranged on the front panel and a corresponding fastener arranged on the rear panel, said fastener and said corresponding fastener able to mate in order to close or cover the opening of the major receptacle.

9. The seal of claim 1, wherein the gusset is stretchable along at least one axis.

10. The seal as claimed in claim 1, wherein the gusset is stretchable along an axis parallel to the gusset upper edge such that a length of the upper edge is able to elongate by at least 100%.

11. The seal of claim 1, wherein the first and second edges of the gusset extend upwardly and outwardly in a V-shape from a lowermost portion thereof.

12. The seal as claimed in claim 11, wherein an internal angle between the first and second edges is between 25° to 80°.

* * * * *